US009503822B2

(12) United States Patent
Zhao et al.

(10) Patent No.: US 9,503,822 B2
(45) Date of Patent: Nov. 22, 2016

(54) ELECTROACOUSTIC TRANSDUCER

(71) Applicant: GOERTEK INC., WeiFang (CN)

(72) Inventors: Guodong Zhao, Weifang (CN); Lianshan Ge, Weifang (CN); Xiaodong Cai, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/430,881

(22) PCT Filed: Nov. 21, 2013

(86) PCT No.: PCT/CN2013/087609

§ 371 (c)(1),
(2) Date: Mar. 24, 2015

(87) PCT Pub. No.: WO2014/079376

PCT Pub. Date: May 30, 2014

(65) Prior Publication Data

US 2015/0256939 A1 Sep. 10, 2015

(30) Foreign Application Priority Data

Nov. 25, 2012 (CN) ..... 2012 1 0481998

(51) Int. Cl.

| | |
|---|---|
| ***H04R 3/00*** | (2006.01) |
| ***H04R 19/02*** | (2006.01) |
| ***H04R 9/06*** | (2006.01) |
| ***H04R 9/04*** | (2006.01) |
| ***H04R 1/02*** | (2006.01) |
| ***H04R 19/00*** | (2006.01) |
| *H04R 1/06* | (2006.01) |
| *H04R 7/04* | (2006.01) |
| *H04R 7/18* | (2006.01) |

(52) U.S. Cl.

CPC ..... *H04R 19/02* (2013.01); *H04R 1/02* (2013.01); *H04R 9/046* (2013.01); *H04R 9/06* (2013.01); *H04R 19/005* (2013.01); *H04R 1/06* (2013.01); *H04R 7/04* (2013.01); *H04R 7/18* (2013.01)

(58) Field of Classification Search

CPC ..... H04R 9/06; H04R 1/06; H04R 2499/11; H04R 31/006; H04R 9/046; H04R 9/025; H04R 19/005; H04R 2209/024; H04R 2400/03; H04R 2400/07; H04R 9/066; H04R 17/00; H04R 31/00; H04R 7/18; H04R 9/00; H04R 19/02; H04R 1/02; H04R 2209/022; H04R 23/002; H04R 2201/028; H04R 2205/21; H04R 2217/03; H04R 3/002; H04R 19/013; H04R 1/403; H04R 29/003; H04R 7/20

USPC ..... 381/396, 190, 394, 400, 409, 410, 412, 381/191, 386, 398, 404, 405, 431, 432, 55, 381/74, 98, 111, 113, 116, 164, 96, 120, 381/426, 59, 150, 337, 345

See application file for complete search history.

(56) References Cited

U.S. PATENT DOCUMENTS

| | | | | |
|---|---|---|---|---|
| 4,413,161 | A * | 11/1983 | Matsumoto | H04R 9/047 381/408 |
| 2002/0141610 | A1 | 10/2002 | Devantier et al. | |
| 2012/0177215 | A1 * | 7/2012 | Bose | G01D 5/2417 381/74 |

FOREIGN PATENT DOCUMENTS

| | | | |
|---|---|---|---|
| CN | 101984677 | A | 3/2011 |
| CN | 202059561 | U | 11/2011 |

(Continued)

OTHER PUBLICATIONS

International search report for PCT/CN2013/087609 filed on Nov. 21, 2013.

*Primary Examiner* — Akelaw Teshale

(57) ABSTRACT

An electroacoustic transducer comprises a diaphragm body part and a voice coil combined to one side of the diaphragm body part, wherein the diaphragm body part comprises non-conductive base material layers and a conductive metal layer; the metal layer is interposed between any two neighboring layers of the base material layers, and is provided with first conductive terminals conductively combined with the voice coil; each of the base material layers between the metal layer and the voice coil is provided with open holes which are formed by removal of material to allow the passage of the first conductive terminals; the central part of the diaphragm body part is combined with a reinforcing layer; and the reinforcing layer is combined to one side of the diaphragm body part away from the voice coil, and covers the regions where the first conductive terminals are located.

11 Claims, 3 Drawing Sheets

(56) References Cited

FOREIGN PATENT DOCUMENTS

| | | | |
|---|---|---|---|
| CN | 202269008 | U | 6/2012 |
| CN | 202435594 | U | 9/2012 |
| CN | 103024638 | A | 4/2013 |
| CN | 202957968 | U | 5/2013 |
| EP | 2 472 905 | A1 | 7/2012 |
| JP | 2006-080938 | A | 3/2006 |

* cited by examiner

ELECTROACOUSTIC TRANSDUCER

TECHNICAL FIELD

The present invention relates to electroacoustic field, particularly to an electroacoustic transducer.

BACKGROUND ART

In the prior art, an electroacoustic transducer comprises a diaphragm and a voice coil combined to one side of the diaphragm, and also comprises an electric connector for electrically connecting internal and external circuitry of the electroacoustic transducer, wherein the voice coil comprises two voice coil leads which are electrically connected with two electrodes of the electric connector through spot welding, and the electric connector is electrically connected with the external circuit as well to control the electric signals in the voice coil through the electric signals in final product.

Typically, the leads of the voice coil are required to have a certain extension to be electrically connected to the electric connector, however, this structure of the electroacoustic transducer has a disadvantage that the wire of the leads tends to break during the vibration of the voice coil causing failure of the product.

Thus, there is a demand for improving the electroacoustic transducer of such a structure to eliminate the above disadvantage.

SUMMARY OF THE INVENTION

In order to solve the above technical problem, the present invention provides an electroacoustic transducer which can be used for preventing the disadvantages of disconnection of the leads of the voice coil due to a long extension of the leads and improving the stability of the product.

In order to achieve the above objective, the present invention provides an electroacoustic transducer comprising a diaphragm body part and a voice coil which is combined to one side of the diaphragm body part, wherein the diaphragm body part comprises non-conductive base material layers and a conductive metal layer, the base material layers comprise at least two layers, and the metal layer is interposed between any two neighbouring layers of the base material layers.

The metal layer is provided with first conductive terminals which are conductively combined with the voice coil, and the base material layers between the metal layer and the voice coil are provided with open holes for allowing the passage of the first conductive terminals which are formed by removal of material.

The central part of the diaphragm body part is combined with a rigid reinforcing layer, and the reinforcing layer is combined to one side of the diaphragm body part away from the voice coil, and covers the region where the first conductive terminals are located.

In addition, it is preferable that the metal layer is provided with second conductive terminals extended from the base material layers, and the second conductive terminals are located at the edge of the diaphragm body part.

In addition, it is preferable that the first conductive terminals and the second conductive terminals are electroplated with metallic protective layers.

In addition, it is preferable that the electroacoustic transducer further comprises a shell for accommodating and fixing the diaphragm body part, and an electric connector conductively combined with the second conductive terminals is arranged at positions on the shell corresponding to the second conductive terminals.

In addition, it is preferable that the material of each of the base material layers is selected from one or more of PEEK, PEN, PEI, PAR, PET, PPS and PES.

In addition, it is preferable that the metal layer is copper foil or copper metal layer formed by electroplating; and the metallic protective layer is tin metal layer.

In addition, it is preferable that the diaphragm body part comprises a dome portion located at the central part thereof, a surround portion located at the edge thereof, and a joint portion located at the edge of the surround portion for combining with the shell; the metal layer comprises a first metal layer distributed on the dome portion, a second metal layer distributed on the joint portion, and a third metal layer distributed on the surround portion for connecting the first metal layer with the second metal layer; wherein each of the first and second metal layers is provided with two separate parts, and the respective separate parts of the first metal layer and the second metal layer, and the third metal layer form two separate electrodes.

In addition, it is preferable that the first and second metal layers have an annular structure, and each of the first and second metal layers is provided with cutoff portions for separating each of the first metal layer and the second metal layer into two parts separately; and the third metal layer has a strip-shaped structure.

In addition, it is preferable that the diaphragm has a rectangular structure, and the third metal layer is distributed at two long sides of the rectangular diaphragm.

In addition, it is preferable that the third metal layer is a structure of three strips arranged in parallel.

In contrast to conventional structure, the electroacoustic transducer of the above structure can prevent the disadvantage of disconnection of the lead of the voice coil due to a long extension during the operation process, improving the stability of the product.

BRIEF DESCRIPTION OF THE FIGURES

The above features and technical advantages will become more apparent and easily understood upon reading the description of the invention in connection with the following drawings.

DETAILED DESCRIPTION

The present invention is described in details in connection with the accompanying drawings and particular embodiments.

Figure 1:
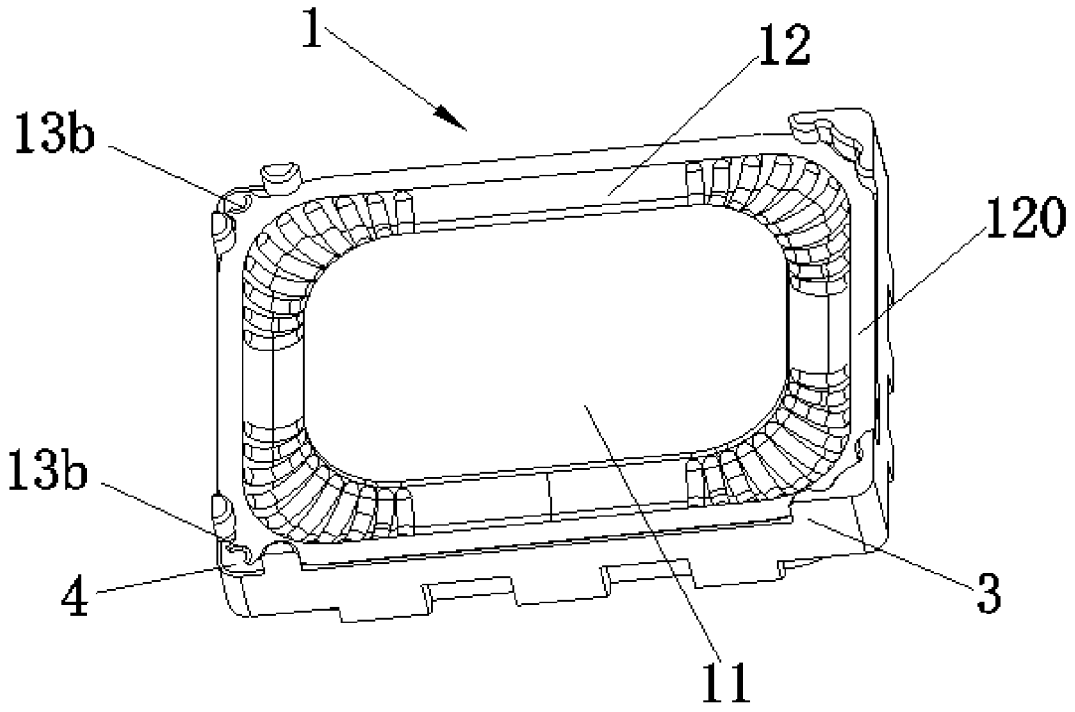
FIG. 1 is a schematic view illustrating the 3D structure of the electroacoustic transducer according to one embodiment of the present invention.
Figure 2:
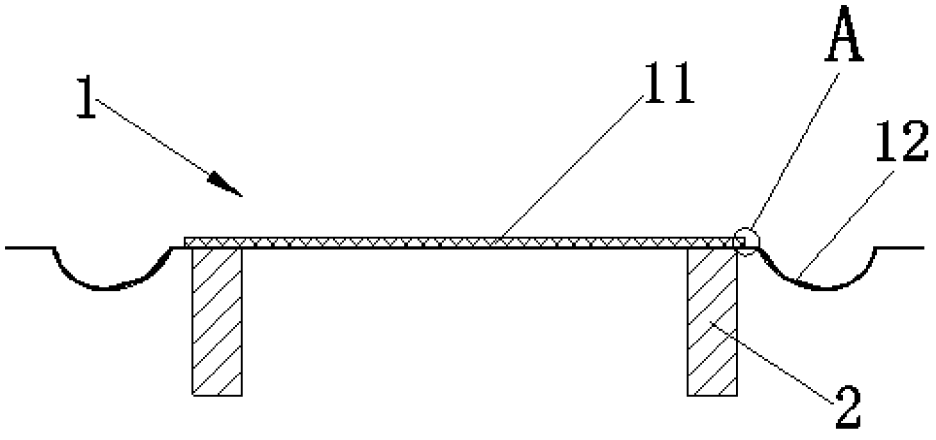
FIG. 2 is a schematic view illustrating the 3D structure of the vibrating system of the electroacoustic transducer according to one embodiment of the present invention.
Figure 3:
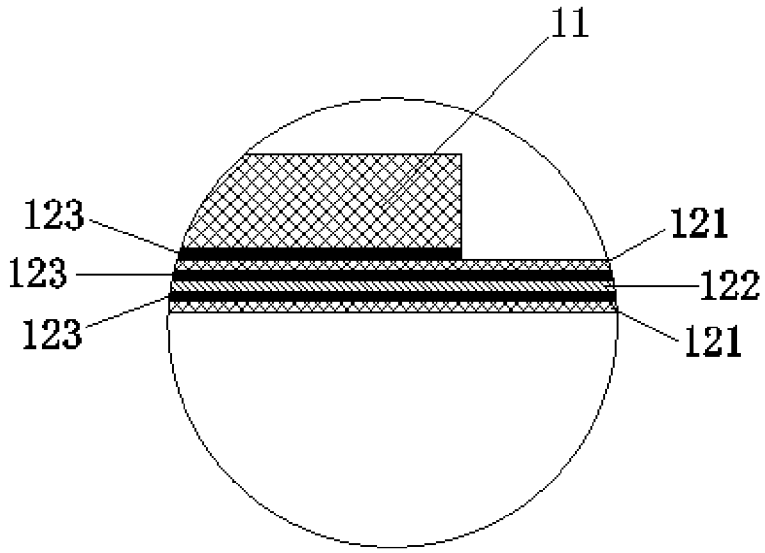
FIG. 3 is an enlarged schematic structure view of part A shown in FIG. 2.

As illustrated in FIG. 1 to FIG. 3, the electroacoustic transducer according to one embodiment of the present invention comprises a vibrating system, a magnetic circuit system (not shown, as general common knowledge in the field), and a shell 3 for accommodating and fixing the vibrating system and the magnetic circuit system. As illustrated in FIG. 1 and FIG. 2, the vibrating system comprises a diaphragm 1 and a voice coil 2 combined at the lower side of the diaphragm 1, the voice coil 2 is electrically connected with external circuitry, and the electric signal in the voice coil 2 is controlled by the electric signal in the final product. The voice coil 2 supplied with electric signal interacts with the magnetic circuit system to vibrate up and down during operation, thereby driving the diaphragm 1 to vibrate and thus generating sounds.

The diaphragm 1 comprises a flexible diaphragm body part 12 and a rigid reinforcing part 11 which is combined at the central part of the diaphragm body part 12 to improve the high frequency characteristics of the diaphragm 1. The diaphragm body part 12 is formed of non-conductive base material layers and a conductive metal layer, the base material layers comprise at least two layers, and the metal layer is combined between any two neighbouring layers of the base material layers to prevent the metal layer 122 from being short circuited with other components. Preferably, the material of each of the base material layers is selected from one or more of PEEK, PEN, PEI, PAR, PET, PPS, and PES.

As illustrated in FIG. 2 and FIG. 3, the reinforcing part 11 and the diaphragm body part 12 are combined together by adhesive 123. The diaphragm body part 12 in the present embodiment comprises two base material layers 121 and a metal layer 122 combined between the two base material layers 121. The metal layer 122 in the present embodiment is copper foil, and either of the base material layers 121 is combined with the metal layer 122 by adhesive 123, but it is not limited to this way. In addition, the metal layer 122 is not limited to the structure of such metal foil, and can also be a metal layer formed on the base material layer 121 by electroplating, such as a copper metal layer formed by electroplating.

Figure 4:
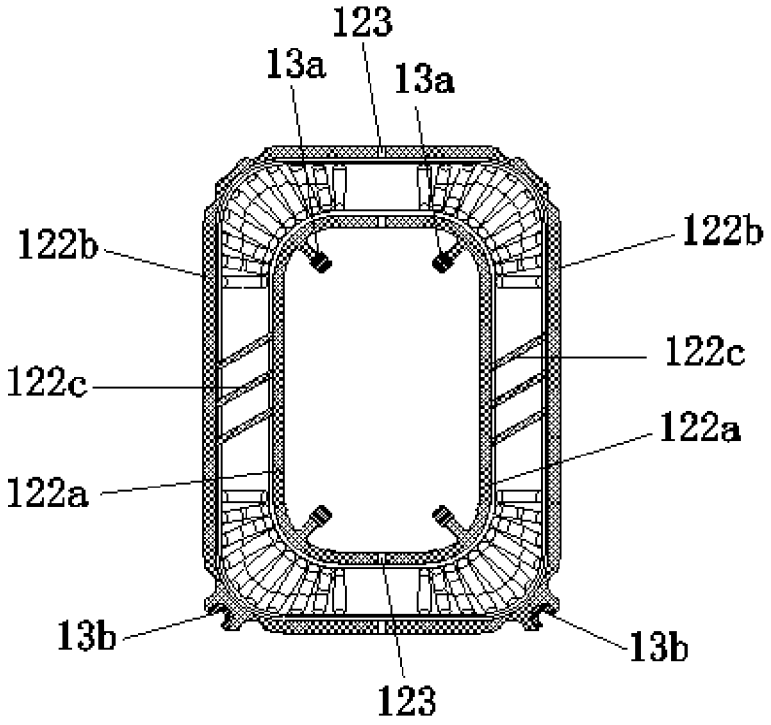
FIG. 4 is a perspective view illustrating the diaphragm of the electroacoustic transducer according to one embodiment of the present invention.
Figure 5:
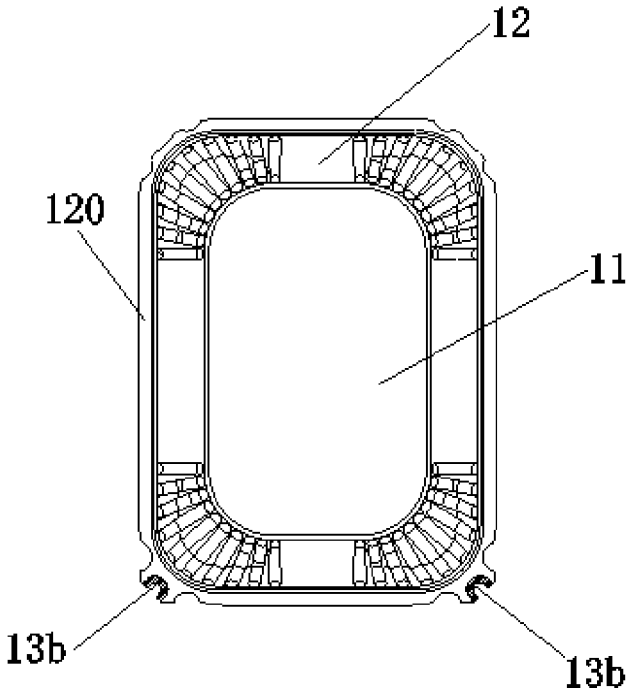
FIG. 5 is a front schematic view illustrating the diaphragm of the electroacoustic transducer according to one embodiment of the present invention.
Figure 6:
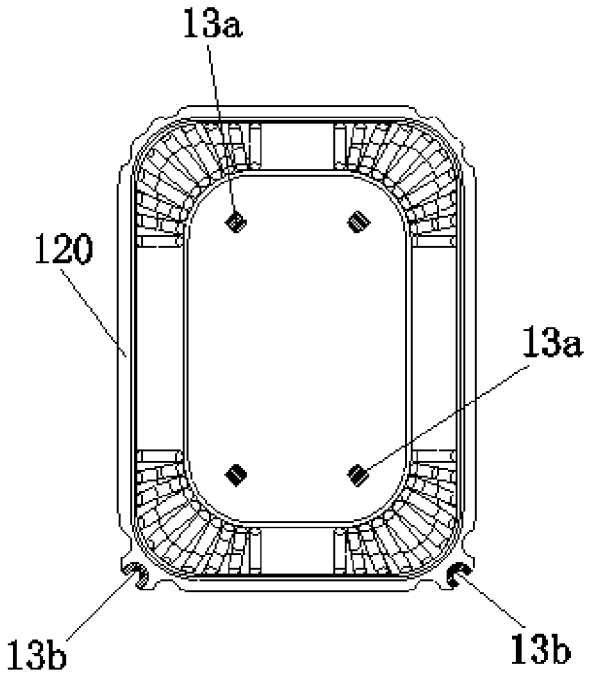
FIG. 6 is a back schematic view illustrating the diaphragm of the electroacoustic transducer according to one embodiment of the present invention.

FIG. 4 is a perspective view of the diaphragm, FIG. 5 is a schematic structure view of the front side (i.e., the side away from the voice coil) of the diaphragm, and FIG. 6 is a schematic structure view of the back side (i.e., the side combined with the voice coil) of the diaphragm. As shown in FIG. 4 to FIG. 6, the metal layer 122 comprises a first metal layer 122*a* located at the inner side thereof, a second metal layer 122*b* located at the outer side thereof, and a third metal layer 122*c* for connecting the first metal layer 122*a* with the second metal layer 122*b*; wherein each of the first metal layer 122*a* and the second metal layer 122*b* comprises two separate parts to form two separate electrodes.

Furthermore, as illustrated in FIG. 1, FIG. 2, FIG. 5 and FIG. 6, the diaphragm body part 12 comprises a planar dome portion located at the central part thereof, a concave surround portion located at the edge thereof, and a joint portion 120 located at the edge of the surround portion for combining with the shell; the dome portion is combined with a reinforcing part 11, and the joint portion 120 is fixed to and combined with the upper surface of the shell 3.

Preferably, the first metal layer 122*a* has a rectangular looped structure, located on the edge of the dome portion of the diaphragm body part 12, close to the surround portion, and is electrically connected with the voice coil 2. In the present invention, in order to form two separate electrodes electrically connected with two leads of the voice coil 2 respectively, two cutoff portions 123 are formed at two short sides of the first metal layer 122*a* having a rectangular looped structure respectively, no metal layer is arranged at the cutoff portions, thus the first metal layer 122*a* forms two parts acting as two separate electrodes, as shown in FIG. 4.

In addition, first conductive terminals 13*a* electrically connected with the looped first metal layer 122*a* are provided at the inner side of the first metal layer 122*a* as well, and the number of the first conductive terminals 13*a* is at least two, so as to be electrically connected with two leads (leading-out terminals) of the voice coil 2. As illustrated in FIG. 4 and FIG. 6, in the present embodiment, two first conductive terminals 13*a* are provided corresponding to each of the electrodes, and the leads of the voice coil 2 can be electrically connected with either one of the two first conductive terminals 13*a* of the related electrode. Open holes for allowing the passage of the first conductive terminals are provided at the positions corresponding to the first conductive terminals 13*a* on the base material layer 121 at the side of the diaphragm body part 12 close to the voice coil 2, so as to provide a convenient way for the leads of the voice coil 2 to be conductively connected with the first conductive terminals 13*a* through spot welding. It should be noted that the reinforcing part 11 can act as a stiffening plate as well during spot welding, so as to prevent risks such as collapse of the diaphragm 1 during spot welding, and thus the reinforcing part 11 should cover the positions where the first conductive terminals 13*a* are located. Preferably, the material of the reinforcing part 11 can be epoxy resin, PET, PEN, sheet metal, PEI, PAR, PPS or PES and the like.

Preferably, the second metal layer 122*b* is located at the position where the edge of the diaphragm body part 1 is combined with the shell 3, thereby reducing the effect of the metal layer 122 on the hardness of the diaphragm 1. Wherein, the second metal layer 122*b* has a rectangular looped structure. In order to form two separate electrodes, cutoff portions 123 are arranged at two short sides of the rectangular second metal layer 122*b*, and no metal layer is arranged at the cutoff portions 123, as shown in FIG. 4. Two corners of the second metal layer 122*b* are provided with two second conductive terminals 13*b*, which are electrically connected with two electrodes formed on the second metal layer 122*b*, and are electrically combined with the electric connectors 4 on the shell 3 through spot welding and the like, as shown in FIG. 1. The base material layers 121 corresponding to the upper and lower sides of the second conductive terminals 13*b* each are provided with exposing structures to allow the second conductive terminals 13*b* to be exposed from the base material layer 121, as shown in FIG. 5 and FIG. 6, so as to be electrically connected with the electric connector 4. Electric signals in the electroacoustic transducer can be controlled by final product through electrical connection with the second conductive terminals 13*b* or electric connector 4.

Preferably, the first conductive terminals 13*a* and the second conductive terminals 13*b* are provided thereon with metallic protective layers formed by electroplating, preferably, tin metal layers with good weldability and ductility.

Preferably, the third metal layer 122*c* has a strip-shaped structure located at two long sides of the rectangular first metal layer 122*a* and the rectangular second metal layer 122*b*, and connects one electrode of the first metal layer 122*a* with a corresponding electrode of the second metal layer 122*b*, and connects the other electrode of the first metal layer 122*a* with the other electrode of the second metal layer 122*b*, respectively. The structure of the third metal layer 122*c* on the long sides can improve the strength of the long sides of the rectangular diaphragm 1, improving acoustic performance of the diaphragm 1. Furthermore, the third metal layer 122*c* is a structure of three strips arranged in parallel, which can improve the stability of electric connection.

With such a structure where the conductive metal layer 122 is arranged inside the diaphragm body part 12, on the diaphragm body part 12 are arranged the first conductive terminals 13*a* electrically combined with the voice coil 2 and the second conductive terminals 13*b* electrically combined with final product or the electric connector 4, electrical connection can be achieved without a long extension from the leads of the voice coil 2, thereby avoiding faults of leads of the voice coil 2 such as disconnection during operation, and improving the stability of the product; and this type of structure may achieve connections with internal and external electric signals directly through the conductive terminals on the diaphragm 1 thus simplifying the manufacturing process of the product and improving the production efficiency of the product.

With the above teaching of the present invention, other improvements and variants can be made by those skilled in the art based on the above embodiments which fall into the scope of the present invention. It will be understood by those skilled in the art that the above specific description aims at providing a better understanding of the present invention, and the scope of the present invention is defined by the claims and their equivalents.

What is claimed is:

1. An electroacoustic transducer comprising a diaphragm body part and a voice coil which is combined to one side of the diaphragm body part, characterized in that the diaphragm body part comprises non-conductive base material layers and a conductive metal layer, the base material layers comprise at least two layers, and the metal layer is arranged between any two neighboring layers of the base material layers;

the metal layer forms two separate electrodes, each of the electrodes is provided with first conductive terminals which are electrically connected with the voice coil; and each of the base material layers between the metal layer and the voice coil is provided with open holes which are formed by removal of material to allow the passage of the first conductive terminals.

2. The electroacoustic transducer according to claim 1, characterized in that, the central part of the diaphragm body part is combined with a rigid reinforcing layer; and the reinforcing layer is combined to one side of the diaphragm body part away from the voice coil, and covers the region where the first conductive terminals are located.

3. The electroacoustic transducer according to claim 1, characterized in that, each of the electrodes is provided with second conductive terminals exposed from each of the base material layers, and the second conductive terminals are located at the edge of the diaphragm body part.

4. The electroacoustic transducer according to claim 3, characterized in that, the first conductive terminals and the second conductive terminals are electroplated thereon with metallic protective layers.

5. The electroacoustic transducer according to claim 3, characterized in that, the electroacoustic transducer further comprises a shell for accommodating and fixing the diaphragm body part, and an electric connector conductively combined with the second conductive terminal is arranged at a position on the shell corresponding to the second conductive terminal.

6. The electroacoustic transducer according to claim 3, characterized in that, the material of each of the base material layers is selected from one or more of PEEK, PEN, PEI, PAR, PET, PPS, and PES.

7. The electroacoustic transducer according to claim 4, characterized in that, the metal layer is a copper foil, or a copper metal layer formed by electroplating; and the metallic protective layer is a tin metal layer.

8. The electroacoustic transducer according to claim 1, characterized in that, the diaphragm body part comprises a dome portion located at the central part thereof, a surround portion located at the edge thereof, and a joint portion located at the edge of the surround portion for combining with the shell;

the metal layer comprises a first metal layer distributed on the dome portion, a second metal layer distributed on the joint portion, and a third metal layer distributed on the surround portion for connecting the first metal layer with the second metal layer;

wherein each of the first and second metal layers is provided with two separate parts, and the respective separate parts of the first and second metal layers and the third metal layer form two separate electrodes.

9. The electroacoustic transducer according to claim 8, characterized in that, each of the first and second metal layers has a looped structure, and each of the first and second metal layers is provided with cutoff portions for separating the first metal layer and the second metal layer into two parts separately; and the third metal layer has a strip-shaped structure.

10. The electroacoustic transducer according to claim 9, characterized in that, the diaphragm has a rectangular structure, and the third metal layer is distributed at two long sides of the rectangular diaphragm.

11. The electroacoustic transducer according to claim 10, characterized in that, the third metal layer has a structure of three strips arranged in parallel.

* * * * *